US008976215B2

(12) United States Patent
Jang

(10) Patent No.: US 8,976,215 B2
(45) Date of Patent: Mar. 10, 2015

(54) IMAGE FORMING APPARATUS AND METHOD OF FORMING IMAGE THEREOF, AND SCANNING UNIT USABLE IN IMAGE FORMING APPARATUS

(71) Applicant: Samsung Electronics Co., Ltd., Suwon-si, Gyeonggi-do (KR)

(72) Inventor: Si-joong Jang, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 14/081,036

(22) Filed: Nov. 15, 2013

(65) Prior Publication Data

US 2014/0139604 A1 May 22, 2014

(30) Foreign Application Priority Data

Nov. 16, 2012 (KR) ..... 10-2012-0130299

(51) Int. Cl.
*B41J 2/435* (2006.01)
*B41J 2/47* (2006.01)
*G03G 15/043* (2006.01)

(52) U.S. Cl.
CPC ..... *G03G 15/043* (2013.01)
USPC ..... 347/235; 347/250

(58) Field of Classification Search
CPC ..... G03G 2215/00008; G03G 2215/00012; G03G 15/043; B41J 2/447; B41J 2/471; B41J 2/473
USPC ..... 347/229, 231, 234, 235, 243, 248–261
See application file for complete search history.

(56) References Cited

U.S. PATENT DOCUMENTS 5,138,479 A * 8/1992 Ando ..... 359/216.1
6,856,338 B2 * 2/2005 Takahashi et al. ..... 347/225
2004/0037584 A1 2/2004 Takahashi et al.

FOREIGN PATENT DOCUMENTS

KR 2004-0021530 3/2004

* cited by examiner

*Primary Examiner* — Hai C Pham
(74) *Attorney, Agent, or Firm* — Staas & Halsey LLP

(57) ABSTRACT

An image forming apparatus includes a plurality of photosensitive media, a light source unit which comprises a plurality of light sources, a polygon mirror which deflects a plurality of beams output from the plurality of light sources into the plurality of photosensitive media using a plurality of reflective surfaces, a beam detector which receives beams reflected from the polygon mirror during a rotating process of the polygon mirror, and outputs a beam detection signal, and a horizontal sync signal generator which receives the beam detection signal and counts beam reflecting times during which the beams are reflected from the plurality of reflective surfaces, and compares the plurality of counted beam reflecting times with the compensation values calculated for the reflective surfaces, respectively, generates a horizontal sync signal for a corresponding reflective surface, and provides the horizontal sync signal to the light source unit.

14 Claims, 9 Drawing Sheets

(a) (b)

IMAGE FORMING APPARATUS AND METHOD OF FORMING IMAGE THEREOF, AND SCANNING UNIT USABLE IN IMAGE FORMING APPARATUS

CROSS-REFERENCE TO RELATED APPLICATIONS

This application claims the benefit of priority under 35 U.S.C. §119 from Korean Patent Application No. 10-2012-0130299, filed on Nov. 16, 2012, in the Korean Intellectual Property Office, the disclosure of which is incorporated herein by reference in its entirety.

BACKGROUND OF THE INVENTION

1. Field of the Invention

Methods and apparatuses consistent with exemplary embodiments relate to an image forming apparatus and a method of forming an image thereof, and more particularly, to an image forming apparatus which generates a horizontal synchronization (sync) signal to compensate for a deviation in reflective surfaces of a polygon mirror in order to prevent deterioration of printing quality, and a method of forming an image thereof.

2. Description of the Related Art

It is common that image forming apparatuses using an electrophotographic method, such as laser printers, copiers, multi-function peripherals, and facsimile machines include a laser scanning unit. The image forming apparatus forms an electrostatic latent image on a surface of a photosensitive medium using laser beams output from the laser scanning unit, transfers the electrostatic latent image to paper, and prints a desired image.

Since the image forming apparatus should output a video signal (or image) to be printed to the photosensitive medium on time, the image forming apparatus is required to generate a horizontal sync signal to control an outputting time of the video signal without error.

Therefore, the conventional image forming apparatus is equipped with the same number of beam detectors as light sources provided in the laser scanning unit in order to detect beams output from the plurality of light sources and reflected, and generates a horizontal sync signal with reference to a beam detection signal of each light source.

However, there has been an attempt to use a single beam detector regardless of the number of light sources for the purpose of saving the cost of materials.

Referring to FIG. 1, the image forming apparatus generates two horizontal sync signals (Hsync) by applying a predetermined time offset according to a beam detection signal (BD) output from a single beam detector. In this case, video data signals (VDO Data) are generated with reference to the horizontal sync signals (Hsync), and, while the video data signals (VDO Data) are generated, beams projected from the light sources enter a surface of a photosensitive medium through a polygon mirror and a reflective mirror, thereby forming a latent image.

In FIG. 1, it is assumed that the polygon mirror is ideally manufactured. That is, since there is no deviation in the reflective surfaces of the polygon mirror, horizontal sync signals (Hsync (M,Y)), which generate video data signals (M, Y VDO Data) using beams that are emitted from light sources but are not directly detected by the beam detector, can be easily estimated using the beam detection signal (BD) detected by the beam detector.

If there is no deviation in the reflective surfaces of the polygon mirror as described above, the horizontal sync signals (Hsync (M, Y)) for the light sources that have no beam detector can be generated, predicting a starting point at which the video data signals (M, Y VDO Data) are generated exactly, using a length of the reflective surface of the polygon mirror and a rotation phase difference of the polygon mirror.

However, if there is a deviation in the reflective surfaces of the polygon mirror, the incoming beam detection signal (BD) has a different period according to each reflective surface of the polygon mirror, and thus, it is impossible to generate an exact horizontal sync signal. As a result, image quality deteriorates as shown in view (b) of FIG. 8.

As described above, since image quality may deteriorate if there is a deviation in the reflective surfaces of the polygon motor, the related-method using two beam detectors and detecting a beam detection signal for every light source should be used, or a strict criterion for judging defectiveness of the polygon motor should be established in order to prevent a deviation in the reflective surfaces. However, there is a problem in that these methods result in increased material costs.

SUMMARY OF THE INVENTION

One or more exemplary embodiments provide an image forming apparatus which generates a horizontal sync signal to compensate for a deviation in reflective surfaces of a polygon mirror in order to prevent deterioration of printing quality, and a method of forming an image thereof.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing an image forming apparatus including a plurality of photosensitive media, a light source unit which includes a plurality of light sources, a polygon mirror which deflects a plurality of beams output from the plurality of light sources into the plurality of photosensitive media using a plurality of reflective surfaces, a beam detector which receives one beam that is output from one of the plurality of light sources and reflected from the polygon mirror during a rotating process of the polygon mirror, and outputs a beam detection signal, a controller which calculates compensation values for the plurality of reflective surfaces using periods of the beam detection signals of the plurality of reflective surfaces, and a horizontal sync signal generator which receives the beam detection signals and counts beam reflecting times during which the beams are reflected from the plurality of reflective surfaces, and compares the plurality of counted beam reflecting times and the compensation values calculated for the reflective surfaces, respectively, generates a horizontal sync signal for a corresponding reflective surface, and provides the horizontal sync signal to the light source unit.

The horizontal sync signal generator may include a receiver which receives the beam detection signals output from the beam detector, a plurality of time offset counters which receive the beam detection signals and counts beam reflecting times during which the beams are reflected from the plurality of reflective surfaces, and a comparator which compares the plurality of beam reflecting times calculated by the plurality of time offset counters and the compensation values calculated for the reflective surfaces, respectively, generates a horizontal sync signal for a corresponding reflective surface, and outputs the horizontal sync signal.

The controller may calculate a compensation value for a certain reflective surface from among the plurality of reflective surfaces by adding periods of the beam detection signals for the plurality of reflective surfaces except for the certain reflective surface.

The controller may calculate the compensation value for each of the plurality of reflective surfaces as a value greater than the period of the beam detection signal of each of the plurality of reflective surfaces.

The foregoing and/or other features and utilities of the present general inventive concept may also be achieved by providing a method of forming an image of an image forming apparatus which includes a plurality of photosensitive media, a plurality of light sources, and a polygon mirror including a plurality of reflective surfaces, the method including deflecting a plurality of beams output from the plurality of light sources into the plurality of photosensitive media using the plurality of reflective surfaces of the polygon mirror, receiving one beam that is output from one of the plurality of light sources and reflected from the polygon mirror, and outputting a beam detection signal, calculating compensation values for the plurality of reflective surfaces using periods of the beam detection signals of the plurality of reflective surfaces, and receiving the beam detection signals and counting beam reflecting times during which the beams are reflected from the plurality of reflective surfaces, and comparing the plurality of counted beam reflecting times and the compensation values calculated for the reflective surfaces, respectively, and generating a horizontal sync signal for a corresponding reflective surface.

The generating the horizontal sync signal may include receiving the beam detection signals output from the beam detector, receiving the beam detection signals and counting beam reflecting times during which the beams are reflected from the plurality of reflective surfaces, and comparing the plurality of counted beam reflecting times and the compensation values calculated for the reflective surfaces, respectively, generating a horizontal sync signal for a corresponding reflective surface, and outputting the horizontal sync signal.

The calculating the compensation values may include calculating a compensation value for a certain reflective surface from among the plurality of reflective surfaces by adding periods of the beam detection signals for the plurality of reflective surfaces except for the certain reflective surface.

The calculating the compensation values may include calculating the compensation value for each of the plurality of reflective surfaces as a value greater than the period of the beam detection signal of each of the plurality of reflective surfaces.

The foregoing and/or other features and utilities of the present general inventive concept may also be achieved by providing a scanning unit usable in an image forming apparatus, comprising a light source, a polygon mirror to deflect a plurality of beams outputted from the light source using a plurality of reflective surfaces thereof, a beam detector to detect one of the deflected beams to output a beam detection signal, and a horizontal sync signal generator to output a horizontal sync signal to the light source according to a comparison between a number of counted beam reflecting times and a compensation value corresponding to the reflective surface.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE EMBODIMENTS

Figure 1:
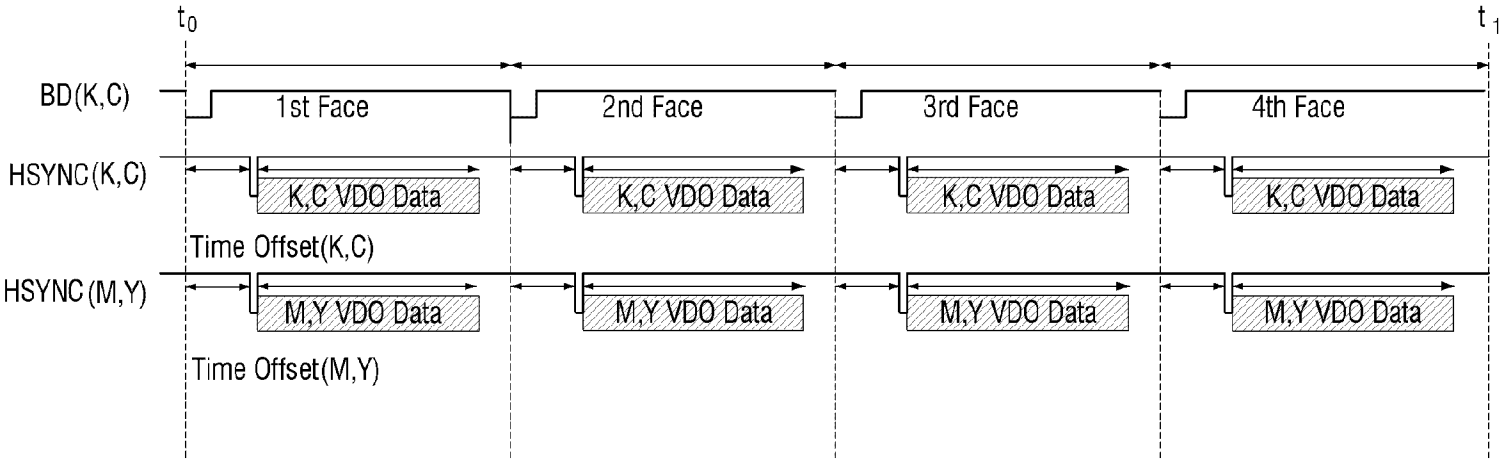
FIG. 1 (RELATED ART)
FIG. 1 is a view illustrating a related-art horizontal sync signal which is generated in an ideal image forming apparatus.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

The matters defined in the description, such as detailed construction and elements, are provided to assist in a comprehensive understanding of exemplary embodiments. Thus, it is apparent that exemplary embodiments can be carried out without those specifically defined matters. Also, functions or elements known in the related art are not described in detail since they would obscure the exemplary embodiments with unnecessary detail.

Figure 2:
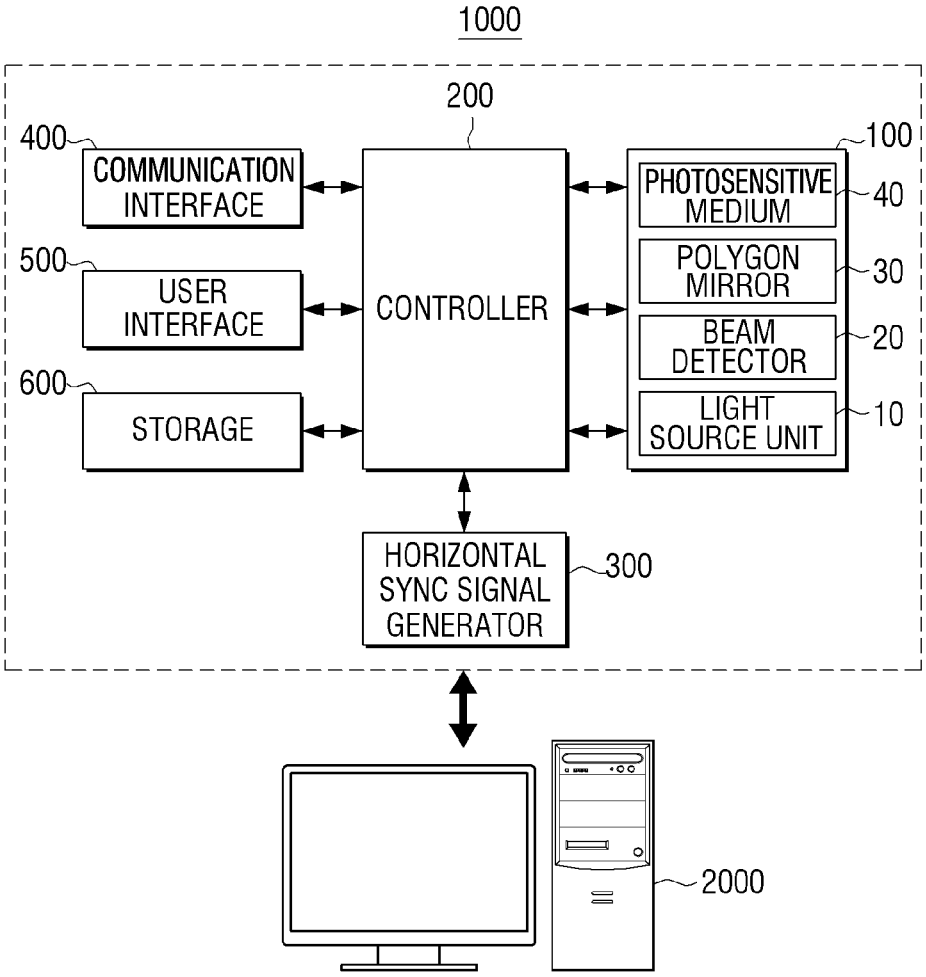
FIG. 2 is a block diagram illustrating an image forming apparatus according to an exemplary embodiment of the present general inventive concept.

FIG. 2 illustrates an image forming apparatus 1000 according to an exemplary embodiment.

Referring to FIG. 2, an image forming apparatus 1000 according to an exemplary embodiment includes a laser scanning unit 100, a controller 200, a horizontal sync signal generator 300, a communication interface 400, a user interface 500, and a storage 600.

At least a portion of the laser scanning unit 100, at least a portion of the controller 200, and the horizontal sync signal generator 300 may be referred to as a scanning control unit to control a laser scanning operation.

The laser scanning unit 100 is an element that forms an electrostatic latent image on a surface of a photosensitive medium using laser beams outputted from a light source, transfers the electrostatic latent image to paper, and prints a desired image, as described above. The laser scanning unit 100 may include a light source unit 10, a beam detector 20, a polygon mirror 30, and a photosensitive medium 40.

Figure 3:
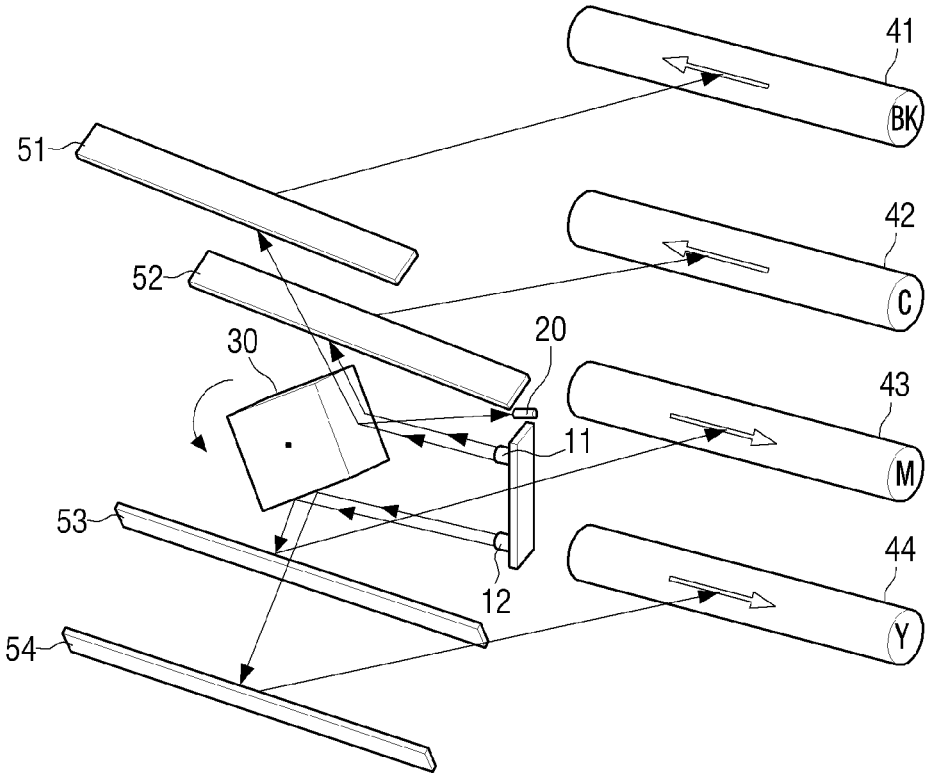
FIG. 3 is a view illustrating a laser scanning unit which is provided in the image forming apparatus according to an exemplary embodiment of the present general inventive concept.

The light source unit 10 includes a light source which generates and outputs laser beams. The light source may use, for example, a semiconductor diode. The light source unit 10 may include a plurality of light sources, and, as shown in FIG. 3, may include the plurality of light sources which are symmetrical vertically with reference to the polygon mirror 30.

In this case, a first light source may output beams to form black and cyan colors, and a second light source may output beams to form magenta and yellow colors. The first light source may be horizontally divided with reference to a reflective surface of the polygon mirror, so that an upper side outputs a beam to form black color and a lower side outputs a beam to form cyan color. The second light source may be horizontally divided like the second light source, and may output beams to form magenta and yellow colors.

The light source unit 10 may output beams corresponding to a video data signal under the control of the controller 200.

Hereinafter, the light sources of the light source unit 10 will be referred to as K and C light sources to form black and cyan colors, and M and Y light sources to form magenta and yellow colors.

The beam detector 20 receives one beam that is outputted from one of the plurality of light sources and reflected in the rotating process of the polygon mirror, and outputs a beam detection signal. The beam detector 20 is disposed at a predetermined location. If a beam outputted from one of the plurality of light sources is reflected at a predetermined angle of the polygon mirror, the beam detector 20 detects the beam through its own light sensor and outputs a beam detection signal.

The beam detector 20 may be referred to as a beam detect (BD) sensor.

According to an exemplary embodiment, the beam detector 20 is positioned only on a scan path of one of the K and C light sources and the M and Y light sources, and not on a scan path of the other light sources. The scan path is a path through which a beam output from a light source is reflected and passes.

Hereinafter, for the convenience of explanation, the beam detection signals that are generated by the beam detector 20 detecting beams outputted from the K and C light sources is referred to as BD (K, C), and it is assumed that the beam detector 20 is positioned on the scan path of the K and C light sources.

The polygon mirror 30 deflects a plurality of beams outputted from the plurality of light sources into a plurality of photosensitive media using a plurality of reflective surfaces. The beams outputted from the light source unit 10 are reflected by the reflective surfaces of the rotating polygon mirror 30 along predetermined scan paths.

The polygon mirror 30 is comprised of reflective surfaces of, for example, a cube shape having an angle of 90°, and includes a motor and thus may be rotated. Although other shapes may be used, an ideal polygon mirror 30 having a cube shape includes reflective surfaces of a square shape of an exact 90° angle and is rotated at a constant speed, but an actually produced polygon mirror 30 has a difference in lengths of the reflective surfaces or a difference in the phases of the rotation and thus may cause a deviation in the reflective surfaces.

In this specification, the reflective surfaces of the polygon mirror 30 will be referred to as a first surface, a second surface, a third surface, and a fourth surface for the convenience of explanation.

The photosensitive medium 40 holds a latent image after being scanned by the beams reflected from the polygon mirror 30, attaches a developer onto the latent image, transfers the image to paper, and prints a desired image. In general, the photosensitive medium 40 is a drum type which is called a photosensitive drum.

For example, if the image forming apparatus is a color printer, the image forming apparatus may include a plurality of photosensitive media for black, cyan, magenta, and yellow and may form a color image.

There is a section on the photosensitive medium 40 on which an image is formed by scanned beams, that is, an effective scan width. To form the effective scan width constantly a horizontal sync signal may be used. In this case, the light source unit 10 may start to output a video data signal (VDO data) using the horizontal sync signal.

Each of the elements of the laser scanning unit 100 has been described above. Detailed arrangements of the elements of the laser scanning unit 100 will be explained further below with reference to FIG. 3.

Referring to FIG. 2, controller 200 calculates a compensation value of each of the plurality of reflective surfaces using a period of the beam detection signal reflected from each of the plurality of reflective surfaces. The compensation value may be calculated using the period of the beam detection signal which is generated by the beam detector 20 detecting the beam reflected from each of the reflective surfaces of the polygon mirror 30.

The compensation value refers to a value that is needed to generate a horizontal sync signal of a light source that does not have the beam detector 20. The controller 200 may compensate for a deviation in the reflective surfaces of the polygon mirror 30 using the compensation value, and may generate an exact horizontal sync signal with respect to the light source without the beam detector 20.

According to an exemplary embodiment, since the beam detector 20 is in position for the K and C light sources, the controller 200 may generate horizontal sync signals for the K and C light sources by applying a predetermined time offset with reference to the BD (K, C). However, since the beam detector 20 is not positioned for the M and Y light sources, the controller 200 may generate horizontal sync signals for the M and Y light sources by applying compensation values and a predetermined time offset with reference to the BD (K, C).

A method of calculating a compensation value will be explained in detail below with reference to FIGS. 5 and 7.

Referring again to FIG. 2, the controller 200 controls the elements of the image forming apparatus 1000. If the controller 200 receives printing data from a printing control apparatus 2000, the controller 200 may control the storage 600 to temporarily store the received printing data.

The controller 200 may control the laser scanning unit 100 and the horizontal sync signal generator 300 to perform halftoning with respect to the stored printing data and form binary data, and to print the generated binary data.

The horizontal sync signal generator 300 generates a horizontal sync signal using a beam detection signal and a compensation value.

For example, since the beam detector 20 is in position for the K and C light sources, the horizontal sync signal generator 300 may generate horizontal sync signals for the K and C light sources by applying a predetermined time offset with reference to the beam detection signals, that is, BD (K, C). In this case, the compensation value is not required.

However, since the beam detector 20 is not in position for the M and Y light sources, the horizontal sync signal generator 300 may generate horizontal sync signals for the M and Y light sources by applying compensation values and a predetermined time offset with reference to the beam detection signals, that is, BD (K, C).

According to a first exemplary embodiment, the horizontal sync signal generator 300 may generate horizontal sync signals for the plurality of reflective surfaces using a plurality of time offset counters corresponding to the plurality of reflective surfaces.

The horizontal sync signal generator 300 may include a receiver which receives the beam detection signals output from the beam detector 20, a plurality of time offset counters which receive the beam detection signals and count a beam reflecting time during which each beam is reflected from each of the plurality of reflective surfaces, and a comparator which compares the plurality of beam reflecting times counted by the plurality of time offset counters and the compensation values calculated for the reflective surfaces, and, if the beam reflecting time and the compensation value are consistent with each other, generates a horizontal sync signal for the corresponding reflective surface, and outputs the horizontal sync signal.

Each element of the horizontal sync signal generator 300 according to the first exemplary embodiment will be explained in detail below with reference to FIG. 4.

According to a second exemplary embodiment, the horizontal sync signal generator 300 may generate horizontal sync signals for the plurality of reflective surfaces using periods of beam detection signals for the plurality of reflective surfaces.

The horizontal sync signal generator may thus include a receiver which receives the beam detection signals outputted from the beam detector, a time offset counter which receives the beam detection signals and counts a beam reflecting time during which each beam is reflected, a period calculator which receives the beam detection signals and calculates periods of the beam detection signals reflected from the plurality of reflective surfaces, a determination unit which determines a compensation value to be applied to a corresponding reflective surface from among the compensation values calculated by the controller, using the periods of the beam detection signals reflected from the plurality of reflective surfaces, and a comparator which compares the beam reflecting time counted by the time offset counter and the determined compensation value, and, if the beam reflecting time and the compensation value are consistent with each other, generates a horizontal sync signal for the corresponding reflective surface and outputs the horizontal sync signal.

Each element of the horizontal sync signal generator 300 according to the second exemplary embodiment will be explained in detail below with reference to FIG. 6.

Referring back to FIG. 2, the communication interface 400 may be configured to connect the image forming apparatus 1000 to the printing control terminal apparatus 2000, and may access the printing control terminal apparatus 2000, for example, through a local area network (LAN) or the internet, or may access the printing control terminal apparatus 2000 through a universal serial bus (USB) port. The communication interface 400 may receive printing data from the printing control terminal apparatus 2000. The received printing data may be data having resolution of 1200×1200 dpi, or may be vector data or contone data.

The user interface 500 may include a plurality of function keys through which a user sets or selects various functions supported by the image forming apparatus 1000, and may display a variety of information provided by the image forming apparatus 1000. The user interface 500 may be implemented, for example, by combining a monitor and a mouse, or by using an apparatus that implements input and output simultaneously such as a touch pad.

The storage 600 stores printing data which is received through the communication interface 400. The storage 600 may store a compensation value for each of the plurality of reflective surfaces, which is calculated by the controller 200 as described above.

Although one storage 600 is illustrated in the present exemplary embodiment, the storage 600 may be implemented including more than one storage element, for example, by using a memory to store data and a memory to process commands.

As described above, the image forming apparatus 1000 according to an exemplary embodiment may generate a horizontal sync signal to compensate for a deviation in the reflective surfaces of the polygon mirror in order to prevent deterioration of printing quality.

FIG. 3 illustrates a laser scanning unit 100 which is provided in an image forming apparatus according to an exemplary embodiment.

Referring to FIG. 3, the laser scanning unit 100 according to the exemplary embodiment includes a plurality of light sources 11 and 12, a beam detector 20, a polygon mirror 30, a plurality of reflective mirrors 51, 52, 53, and 54, and a plurality of photosensitive media 41, 42, 44, and 44.

The plurality of light sources 11 and 12 are disposed on the left and the right with reference to the polygon mirror 30.

The light source 11 outputs beams corresponding to black (BK) and cyan (C), and the light source 12 outputs beams corresponding to magenta (M) and yellow (Y).

As described above with reference to FIG. 2, the first light source 11 may output beams to form black and cyan colors, and the other second light source 12 may output beams to form magenta and yellow colors. The first light source 11 is horizontally divided with reference to the reflective surface of the polygon mirror so that that an upper side outputs a beam to form black color and a lower side outputs a beam to form cyan color. The second light source 12 may be horizontally divided like the first source so that the second light source 12 outputs beams to form magenta and yellow colors.

The polygon mirror 30 is driven by a motor as described above with reference to FIG. 2, and reflects beams outputted from the plurality of light sources 11 and 12 at a predetermined angle.

The plurality of reflective mirrors 51, 52, 53, and 54 reflect the beams reflected from the polygon mirror 30 in predetermined directions and direct the beams to enter surfaces of the plurality of photosensitive media 41, 42, 43, and 44, on which an image is formed.

The beam detector 20 includes a light sensor to detect a beam as described above with reference to FIG. 2. In the conventional image forming apparatus, the same number of beam detectors as light sources are provided. However, the image forming apparatus 1000 includes one beam detector 20 for one polygon mirror 30 as shown in FIG. 3.

The beam detector 20 detects one beam that is outputted from one of the plurality of light sources (i.e., light source 11) and reflected from the polygon mirror 30, and generates a beam detection signal. The generated beam detection signal may be used to generate a horizontal sync signal to compensate for an error between scan lines.

Hereinafter, the horizontal sync signal generator 300 to generate a horizontal sync signal for a light source that does not have the beam detector 20 will be explained. The horizontal sync signal for the light source that has the beam detector 20 may be generated by applying a predetermined time offset to the beam detection signal. However, the horizontal sync signal for the light source that does not have the beam detector 20 should be generated in consideration of a deviation in the reflective surfaces of the polygon motor 30. Therefore, the following horizontal sync signal generator 300 is required.

Figure 4:
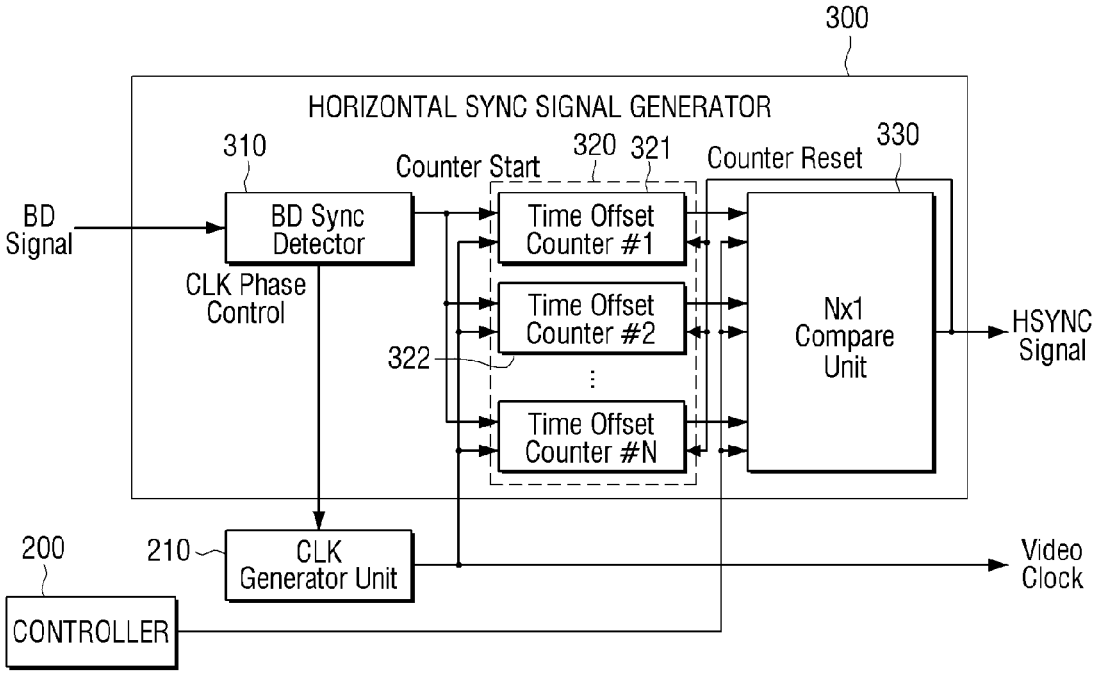
FIG. 4 is a block diagram illustrating a horizontal sync signal generator according to a first exemplary embodiment of the present general inventive concept.

FIG. 4 illustrates the horizontal sync signal generator according to the first exemplary embodiment.

The horizontal sync signal generator 300 according to the first exemplary embodiment may generate horizontal sync signals for the plurality of reflective surfaces using a plurality of time offset counters corresponding to the plurality of reflective surfaces.

The horizontal sync signal generator 300 according to the first exemplary embodiment includes a receiver 310, a plurality of time offset counters 320, and a comparator 330.

The receiver 310 may be referred to as a BD sync detector and receives a beam detection signal output from the beam detector 20. The receiver 310 generates a signal to operate the time offset counters 320 according to the received detection signal.

The receiver 310 may generate a control signal (CLK Phase Control) to match a clock phase with the beam detection signal, and may provide the control signal to a clock generation unit 210 of the image forming apparatus 1000.

The plurality of time offset counters 320 perform a counter operation according to the beam detection signal of the receiver 310. Specifically, if a first beam detection signal is received, the first time offset counter 321 is driven and performs a counter operation, and, if a second beam detection signal is received, the second time offset counter 322 is driven and performs a counter operation. In this way, if an Nth beam detection signal is received, the Nth time offset counter may be driven. N indicates the number of reflective surfaces of the polygon mirror. Accordingly, in the present exemplary embodiment, N=4 and thus four time offset counters may be included.

Results of counting by the plurality of time offset counters 320, that is, a plurality of beam reflecting times, may be transmitted to the comparator 330.

The comparator 330 compares the plurality of beam reflecting times counted by the plurality of time offset counters 320 and the compensation values calculated for the reflective surfaces, respectively, and generates a horizontal sync signal for a corresponding reflective surface and outputs the horizontal sync signal.

The comparator 300 compares the plurality of beam reflecting times counted by the plurality of time offset counters 320 with values that are calculated by applying a predetermined offset to the compensation values calculated by the controller 200, and, if the beam reflecting time and the compensation value are consistent with each other, generates a horizontal sync signal for the reflective surface corresponding to the time offset counter having the consistent value, initializes the time offset counter having the consistent value, and leaves the time offset counter idle until a next beam detection is input.

The compensation value is calculated by the controller 200 as described above and will be explained below with reference to FIG. 5.

Figure 5:
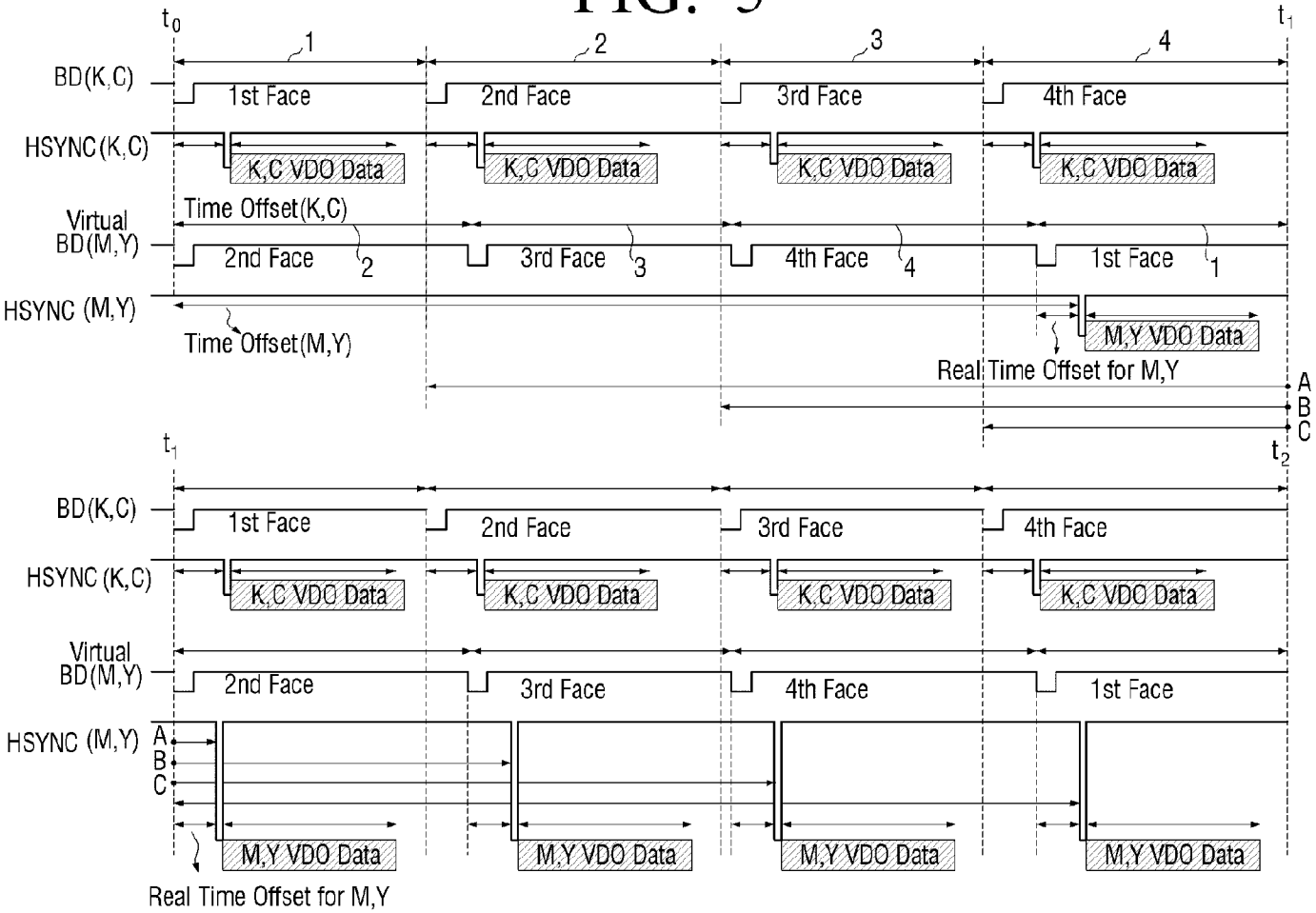
FIG. 5 is a timing chart illustrating a horizontal sync signal which is generated in the image forming apparatus according to the first exemplary embodiment of the present general inventive concept.

FIG. 5 illustrates the horizontal sync signal which is generated in the image forming apparatus according to the first exemplary embodiment.

The controller 200 may calculate compensation values to generate horizontal sync signals for the M and Y light sources, which do not have the beam detector 20.

In the first exemplary embodiment, a compensation value for a certain reflective surface may be calculated by adding periods of light detection signals of the plurality of reflective surfaces except for the certain reflective surface. Accordingly, the compensation value calculated for the certain reflective surface may be greater than the period of the beam detection signal of the certain reflective surface.

For example, if the polygon mirror 30 is rotated in an order of first surface, second surface, third surface, fourth surface, and first surface with respect to the K and C light sources, then the reflective surfaces proceed in an order of second surface, third surface, fourth surface, first surface, and second surface with respect to the M and Y light sources. Accordingly, since the first surface reaches the M and Y light sources after the second surface, the third surface, and the fourth surface, the compensation value of the first surface for the M and Y light sources may be obtained by adding the period of the beam detection signal of the second surface, the period of the beam detection signal of the third surface, and the period of the beam detection signal of the fourth surface.

Referring to FIG. 5, the horizontal sync signal (HSYNC (M, Y)) of the first surface for the M and Y light sources is equal to the total of the period (2) of the beam detection signal of the second surface, the period (3) of the beam detection signal of the third surface, the period (4) of the beam detection signal of the fourth surface, and a predetermined offset value.

As a result, the horizontal sync signal with a constant real time offset can be generated for the M and Y light sources which do not have the beam detector 20 using the above-described compensation value.

On the other hand, if the polygon mirror 30 is rotated in the opposite direction in order of the first surface, the fourth surface, the third surface, the second surface, and the first surface with respect to the K and C light sources, the reflective surfaces proceed in order of the second surface, the first surface, the fourth surface, the third surface, and the second surface with respect to the M and Y light sources. Accordingly, since the first surface reaches the M and Y light sources after the second surface, the compensation value of the first surface for the M and Y light sources may be obtained based on the period of the beam detection signal of the second surface. If such a small compensation value is calculated by changing the rotation direction, a problem of an inexact horizontal sync signal being generated due to an accumulation of minor errors caused by the time offset counters can be minimized.

Figure 6:
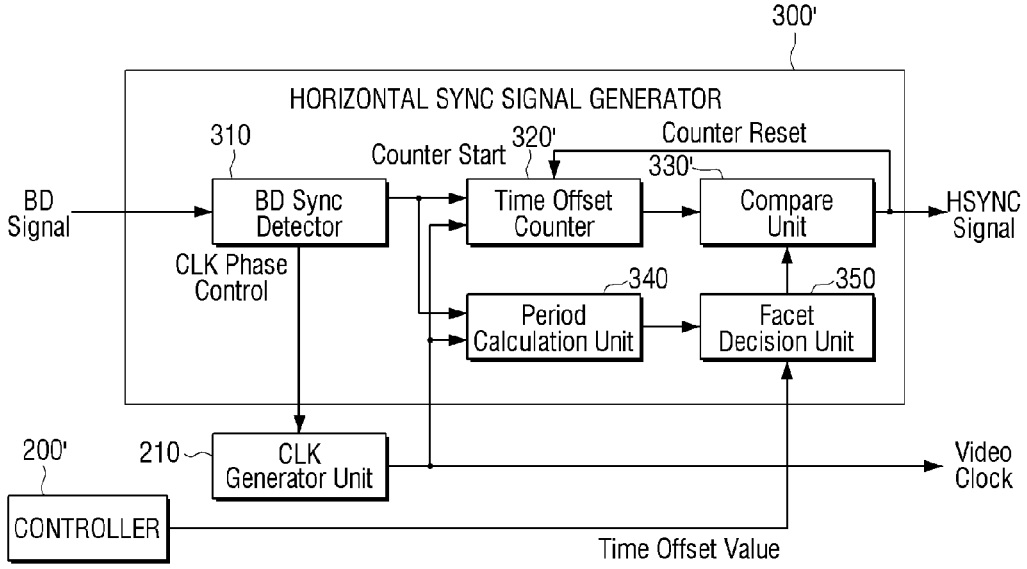
FIG. 6 is a block diagram illustrating a horizontal sync signal generator according to a second exemplary embodiment of the present general inventive concept.

The horizontal sync signal generator 300 according to the first exemplary embodiment has been described above, but the horizontal sync signal generator may be implemented by using a following horizontal sync signal generator 300' as shown in FIG. 6.

FIG. 6 illustrates the horizontal sync signal generator according to the second exemplary embodiment.

According to the second exemplary embodiment, the horizontal sync signal generator 300' may generate horizontal sync signals for the plurality of reflective surfaces using periods of beam detection signals of the plurality of reflective surfaces.

The horizontal sync signal generator 300' according to the second exemplary embodiment includes a receiver 310, a time offset counter 320', a comparator 330', a period calculator 340, and a determination unit 350.

The receiver 310 may be referred to as a BD sync detector and receives a beam detection signal detected by the beam detector 20. The receiver 310 generates a signal to operate the time offset counter 320' according to the received beam detection signal.

Also, the receiver 310 may generate a control signal (CLK Phase Control) to match a clock phase with the beam detection signal and may provide the control signal to a clock generation unit 210 of the image forming apparatus 1000.

The time offset counter 320' performs a counter operation according to the beam detection signal of the receiver 310.

Unlike in the first exemplary embodiment, a single time offset counter is provided in the second exemplary embodiment and performs a counter operation every time that the beam detection signal is input, and provides a result of counting, that is, a beam reflecting time, to the comparator 330' and the period calculator 340.

The period calculator 340 receives the beam detection signals and calculates periods of the beam detection signals reflected from the plurality of reflective surfaces. Specifically, the period calculator 340 receives the beam detection signals from the receiver 310 and calculates the periods of the beam detection signals reflected from the plurality of reflective surfaces.

In the second exemplary embodiment, the period calculator 340 is included in the horizontal sync signal generator 300' and calculates the periods of the beam detection signals. However, the period calculator 340 may be included in the controller 200' so that the controller 200' itself can calculate the periods of the beam detection signals.

The determination unit 350 determines a compensation value to be applied to a corresponding reflective surface from among the compensation values calculated by the controller 200' using the periods of the beam detection signals reflected from the plurality of reflective surfaces. The determination unit 350 sets a surface having a minimum period as a first surface, using the periods of the beam detection signals reflected from the plurality of reflective surfaces that are calculated by the period calculator 340. The determination unit 350 defines a second surface, a third surface, and a fourth surface in rotating order with reference to the first surface, and determines a compensation value to be applied to the corresponding reflective surface from among the compensation values for the reflective surfaces calculated by the controller 200', and provides the compensation value to the comparator 330'.

The compensation values calculated by the controller 200' will be explained in detail below with reference to FIG. 7.

Referring back to FIG. 6, the comparator 330' compares the beam reflecting time which is calculated by the time offset counter 320' with the compensation value which is determined by the determination unit 350, and generates a horizontal sync signal for the corresponding reflective surface. The comparator 330' compares the reflecting time counted by the time offset counter 320' with a value that is obtained by applying a predetermined time offset to the compensation value determined by the determination unit 350. If the reflecting time and the value are consistent with each other, the comparator 330' generates a horizontal sync signal for the corresponding reflective surface, initializes the time offset counter, and leaves the time offset value idle until a next beam detection signal is input.

Figure 7:
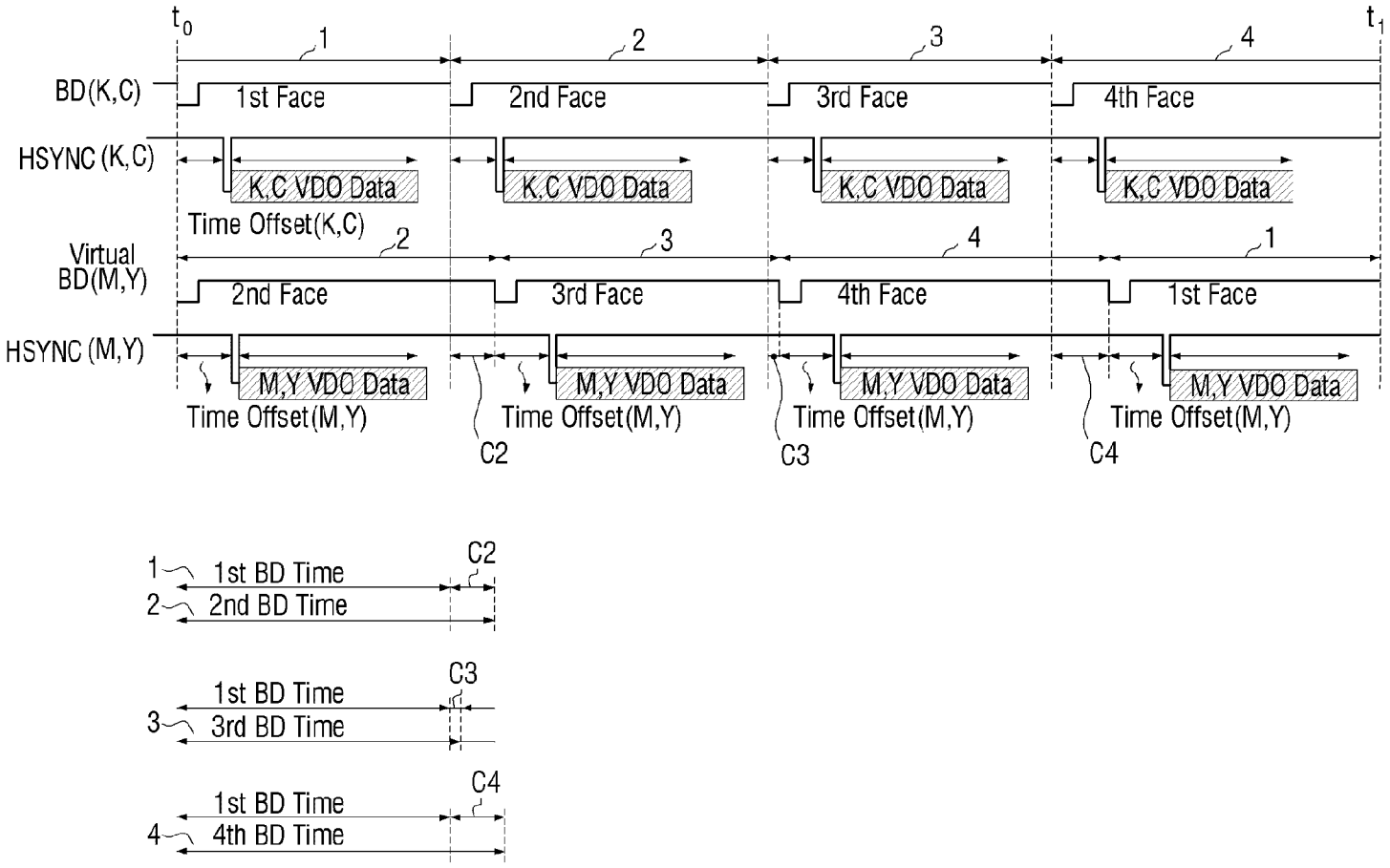
FIG. 7 is a timing chart illustrating a horizontal sync signal which is generated in the image forming apparatus according to the second exemplary embodiment of the present general inventive concept.

FIG. 7 illustrates the horizontal sync signal which is generated in the image forming apparatus according to the second exemplary embodiment.

The controller 200' may calculate a compensation value to generate a horizontal sync signal for the M and Y light sources which do not have the beam detector 20 as described above.

In the second exemplary embodiment, the horizontal sync signals (HSYNC (M, Y)) for the M and Y light sources are generated by applying the compensation values calculated for the reflective surfaces with reference to one beam detection signal.

In the second exemplary embodiment, the compensation value may be calculated using the following equation:

$$C_i = C_{i-1} + (BD_i - BD_{i-m}) \quad \text{[Equation 1]}$$

wherein i is a number of a reflective surface (i>0, an integer), $C_i$ is a compensation value for the reflective surface i, $BD_i$ is a period of a beam detection signal reflected from the reflective surface i, m is a gap between reflective surfaces of the polygon mirror which output video signals simultaneously, and $C_i=0$.

For example, referring to FIG. 7, if a reflective surface that has a minimum period from among the periods of the beam detection signals reflected from the plurality of reflective surfaces is defined as a first surface, the compensation values may be calculated as follows:

compensation value of the first surface $(C_1)=0$;

compensation value of the second surface $(C_2)=BD_2(2)-BD_1(1)$;

compensation value of the third surface $(C_3)=C_2+(BD_3(3)-BD_2(2))=BD_3(3)-BD_1(1)$; and compensation value of the fourth surface $(C_4)=C_3+(BD_4(4)-BD_3(3))=BD_4(4)-BD_1(1)$.

As described above, the horizontal sync signal generator 300 can generate the horizontal sync signals for the M and Y light sources which do not have the beam detector 20 considering the deviation in the reflective surfaces of the polygon mirror.

The light sources that do not have the beam detector 20 are the M and Y light sources in the present exemplary embodiments, but may be set differently according to a manufacturer and are not limited to this setup.

According to various exemplary embodiments, the image forming apparatus 1000 appropriately compensates for the deviation in the reflective surfaces of the polygon mirror 30, so that image quality can be prevented from deteriorating.

Figure 8:
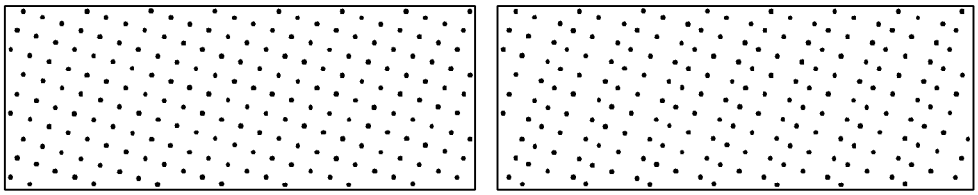
FIG. 8 is a view illustrating a result of printing by applying a horizontal sync signal according to an exemplary embodiment of the present general inventive concept.

FIG. 8 illustrates a result of printing by applying a horizontal sync signal according to an exemplary embodiment.

View (a) of FIG. 8 illustrates a result of printing by applying a horizontal sync signal which compensates for a deviation in reflective surfaces of the polygon mirror.

View (b) of FIG. 8 illustrates a result of printing by applying a horizontal sync signal without compensating for the deviation in the reflective surfaces of the polygon mirror.

If the deviation in the reflective surfaces of the polygon mirror is not compensated for, black and cyan colors maintain the same time offset and thus generate video data signals (VDO Data), but magenta and yellow colors are not constantly formed in a horizontal direction due to the different time offsets and shows a pattern having periods as many as a number of surfaces.

Thus, image deterioration may occur as shown in view (b) of FIG. 8. This may be called moiré which is one of the image deterioration phenomenons.

Figure 9:
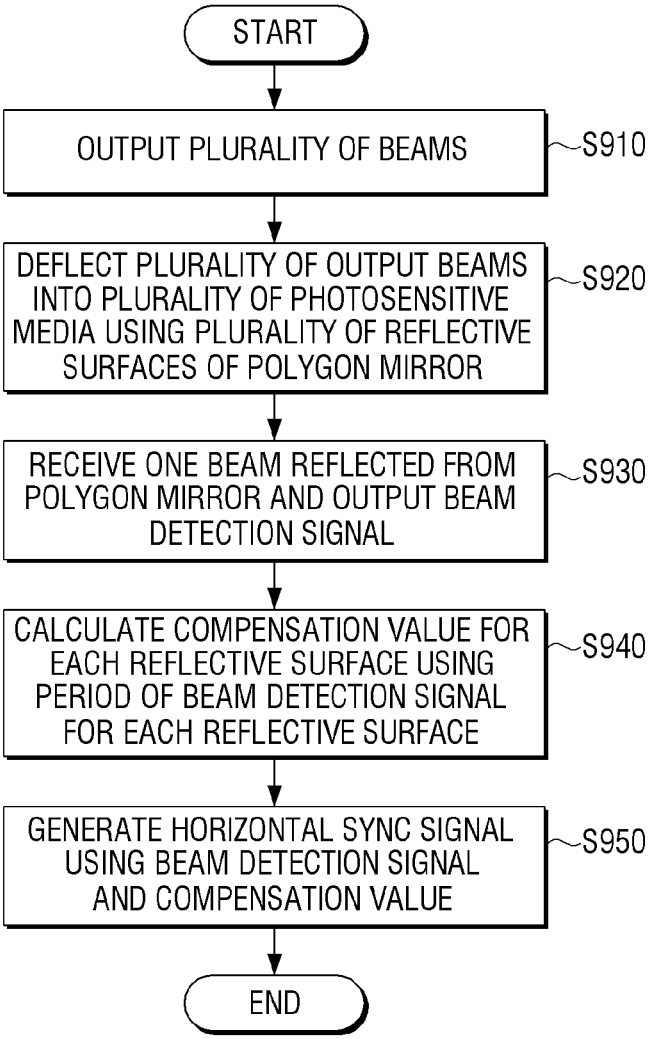
FIG. 9 is a flowchart illustrating a method of forming an image of an image forming apparatus according to an exemplary embodiment of the present general inventive concept.

FIG. 9 illustrates a method of forming an image of the image forming apparatus 1000 according to an exemplary embodiment.

The image forming apparatus 1000, which includes the plurality of photosensitive media, the plurality of light sources, and the polygon mirror including the plurality of reflective surfaces, outputs a plurality of beams through the plurality of light sources at operation S910, and deflects the plurality of output beams into the plurality of photosensitive media using the plurality of reflective surfaces of the polygon mirror at operation S920.

The polygon mirror recited herein may include a motor and may be rotated at a constant speed, and may reflect the plurality of beams toward the plurality of photosensitive media.

The beam detector 20 receives one beam which is outputted from one of the plurality of light sources and reflected from the polygon mirror, and outputs a beam detection signal at operation S930.

A compensation value for each of the plurality of reflective surfaces is calculated using a period of the beam detection signal for each of the plurality of reflective surfaces at operation S940.

According to the first exemplary embodiment, a compensation value for a certain reflective surface from among the plurality of reflective surfaces may be calculated by adding periods of the beam detection signals for the plurality of reflective surfaces except for the certain reflective surface.

On the other hand, a compensation value in the second exemplary embodiment is calculated using the following equation:

$$C_i=C_{i-1}+(BD_i-BD_{i-m}) \quad \text{[Equation 1]}$$

The compensation value is calculated using the above equation. Herein, $C_i$ is a compensation value for the reflective surface i, $BD_i$ is a period of a beam detection signal reflected from the reflective surface i, m is a gap between reflective surfaces of the polygon mirror which output video signals simultaneously, and $C_i=0$.

A horizontal sync signal is generated using the beam detection signal and the calculated compensation value at operation S950.

Output of a video data signal may be controlled with reference to the generated horizontal sync signal.

The method of forming the image of the image forming apparatus shown in FIG. 9 may be executed in the image forming apparatus 1000 having the configuration of FIG. 2, or may be executed in image forming apparatuses having any other configuration.

The methods according to the various exemplary embodiments described above may be programmed and may be stored in various storage media. Accordingly, the methods according to the above-described exemplary embodiments may be implemented in various kinds of electronic apparatuses that execute the storage media.

According to the above-described exemplary embodiments, an image forming apparatus can be implemented which can prevent deterioration of printing quality by generating a horizontal sync signal to compensate for deviations in the reflective surfaces of the polygon mirror.

The present general inventive concept can also be embodied as computer-readable codes on a computer-readable medium. The computer-readable medium can include a computer-readable recording medium and a computer-readable transmission medium. The computer-readable recording medium is any data storage device that can store data as a program which can be thereafter read by a computer system. Examples of the computer-readable recording medium include a semiconductor memory device, a read-only memory (ROM), a random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

Specifically, according to an exemplary embodiment, a non-transitory computer readable medium can store a program to perform, in sequence, deflecting a plurality of beams output from a plurality of light sources into a plurality of photosensitive media using a plurality of reflective surfaces of a polygon mirror, receiving one beam that is output from one of the plurality of light sources and reflected from the polygon mirror, and outputting a beam detection signal, calculating a compensation value for each of the plurality of reflective surfaces using a period of the beam detection signal of each of the plurality of reflective surfaces, and generating a horizontal sync signal using the beam detection signal and the compensation value.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus comprising:

a plurality of photosensitive media;

a light source unit which comprises a plurality of light sources;

a polygon mirror which deflects a plurality of beams outputted from the plurality of light sources into the plurality of photosensitive media using a plurality of reflective surfaces;

a beam detector which receives one beam that is outputted from one of the plurality of light sources and reflected from the polygon mirror during a rotating process of the polygon mirror, and outputs a beam detection signal;

a controller which calculates compensation values for the plurality of reflective surfaces using periods of the beam detection signals of the plurality of reflective surfaces; and a horizontal sync signal generator which receives the beam detection signal, counts a plurality of beam reflecting times during which the beams are reflected from the plurality of reflective surfaces, compares the plurality of counted beam reflecting times with the compensation values calculated for the reflective surfaces, respectively, generates a horizontal sync signal for a corresponding reflective surface according to the comparison result, and provides the horizontal sync signal to the light source unit.

2. The image forming apparatus as claimed in claim 1, wherein the horizontal sync signal generator comprises:

a receiver which receives the beam detection signal outputted from the beam detector;

a plurality of time offset counters which receive the beam detection signal and counts beam reflecting times during which the plurality of beams are reflected from the plurality of reflective surfaces; and a comparator which compares the beam reflecting times calculated by the plurality of time offset counters with the compensation values calculated for the reflective surfaces, respectively, generates a horizontal sync signal for a corresponding reflective surface, and outputs the horizontal sync signal.

3. The image forming apparatus as claimed in claim 1, wherein the controller calculates a compensation value for a certain reflective surface from among the plurality of reflective surfaces by adding periods of the beam detection signal for the plurality of reflective surfaces except for the certain reflective surface.

4. The image forming apparatus as claimed in claim 1, wherein the controller calculates the compensation value for each of the plurality of reflective surfaces as a value greater than the period of the beam detection signal of each of the plurality of reflective surfaces.

5. The image forming apparatus of claim 1, wherein the beam detector is positioned within a path of light reflected from one of the plurality of light sources.

6. A method of forming an image of an image forming apparatus which comprises a plurality of photosensitive media, a plurality of light sources, and a polygon mirror comprising a plurality of reflective surfaces, the method comprising:

deflecting a plurality of beams outputted from the plurality of light sources into the plurality of photosensitive media using the plurality of reflective surfaces of the polygon mirror;

receiving one beam that is outputted from one of the plurality of light sources and reflected from the polygon mirror, and outputting a corresponding beam detection signal;

calculating compensation values for the plurality of reflective surfaces using periods of the beam detection signal; and receiving the beam detection signal and counting beam reflecting times during which the plurality of beams are reflected from the plurality of reflective surfaces, and comparing the counted beam reflecting times with the compensation values calculated for the reflective surfaces, respectively, and generating a horizontal sync signal for a corresponding reflective surface.

7. The method as claimed in claim 6, wherein the generating the horizontal sync signal comprises:

receiving the beam detection signal output from the beam detector;

receiving the beam detection signal and counting beam reflecting times during which the plurality of beams are reflected from the plurality of reflective surfaces; and comparing the counted beam reflecting times with the compensation values calculated for the reflective surfaces, respectively, generating a horizontal sync signal for a corresponding reflective surface, and outputting the horizontal sync signal.

8. The method as claimed in claim 6, wherein the calculating the compensation values comprises: calculating a compensation value for a certain reflective surface from among the plurality of reflective surfaces by adding periods of the beam detection signal for the plurality of reflective surfaces except for the certain reflective surface.

9. The method as claimed in claim 6, wherein the calculating the compensation values comprises calculating the compensation value for each of the plurality of reflective surfaces as a value greater than the period of the beam detection signal of each of the plurality of reflective surfaces.

10. A scanning unit usable in an image forming apparatus, comprising:

a light source;

a polygon mirror to deflect a plurality of beams outputted from the light source using a plurality of reflective surfaces thereof;

a beam detector to detect one of the deflected beams and to output a beam detection signal; and a horizontal sync signal generator to count beam reflecting times, to output a horizontal sync signal to the light source according to a comparison between the beam reflecting times and a compensation value corresponding to the reflective surface.

11. The scanning unit of claim 10, wherein the horizontal sync generator comprises:

a receiver which receives the beam detection signal outputted from the beam detector;

a time offset counter which receives the beam detection signal and counts a beam reflecting time during which each beam is reflected;

a period calculator which receives the beam detection signal and calculates periods of the beam detection signal reflected from the plurality of reflective surfaces, a determination unit which determines a compensation value to be applied to a corresponding reflective surface from among a plurality of calculated compensation values, using the periods of the beam detection signal reflected from the plurality of reflective surfaces; and a comparator which compares the beam reflecting time counted by the time offset counter with the determined compensation value, and, when the beam reflecting time and the compensation value are consistent with each other, generates a horizontal sync signal for the corresponding reflective surface and outputs the horizontal sync signal.

12. The scanning unit of claim 10, wherein the plurality of compensation values are calculated according to the following formula:

$$C_i = C_{i-1} + (BD_i - BD_{i-m})$$

wherein i is a number of a reflective surface (i>0, an integer), $C_i$ is a compensation value for the reflective surface i, $BD_i$ is a period of a beam detection signal reflected from the reflective surface i, m is a gap between reflective surfaces of the polygon mirror which output video signals simultaneously, and $C_i=0$.

13. The scanning unit of claim 10, further comprising a controller which controls the light source according to the horizontal sync signal.

14. The scanning unit of claim 13, wherein the controller calculates compensation values for the plurality of reflective surfaces.

* * * * *